United States Patent [19]

Froeschle

[11] 4,061,890

[45] Dec. 6, 1977

[54] LOUDSPEAKER WITH SINGLE LAYER RECTANGULAR WIRE VOICE COIL WOUND ON SLIT METAL BOBBIN WITH A NOTCH IN THE ADJACENT POLE PLATE

[75] Inventor: Thomas A. Froeschle, Framingham, Mass.

[73] Assignee: Bose Corporation, Framingham, Mass.

[21] Appl. No.: 718,112

[22] Filed: Aug. 27, 1976

[51] Int. Cl.[2] ..... H04R 9/04
[52] U.S. Cl. ..... 179/115.5 VC
[58] Field of Search ..... 179/115.5 VC

[56] References Cited

U.S. PATENT DOCUMENTS

| | | | |
|---|---|---|---|
| 1,962,012 | 6/1934 | Grassmann | 179/115.5 VC |
| 2,769,942 | 11/1956 | Hassan | 179/115.5 VC |
| 3,935,402 | 1/1976 | Gersten | 179/115.5 VC |

FOREIGN PATENT DOCUMENTS

| | | | |
|---|---|---|---|
| 52,474 | 12/1966 | Poland | 179/115.5 VC |
| 694,058 | 7/1953 | United Kingdom | 179/115.5 VC |
| 263,172 | 12/1926 | United Kingdom | 179/115.5 VC |

*Primary Examiner*—George G. Stellar
*Attorney, Agent, or Firm*—Charles Hieken

[57] ABSTRACT

A moving coil loudspeaker is constructed with a low resistance (e.g. one ohm) single layer anodized aluminum rectangular wire voice coil wound on a slit anodized aluminum bobbin and a notch in the adjacent pole plate for the return length of the voice coil wire.

4 Claims, 9 Drawing Figures

LOUDSPEAKER WITH SINGLE LAYER RECTANGULAR WIRE VOICE COIL WOUND ON SLIT METAL BOBBIN WITH A NOTCH IN THE ADJACENT POLE PLATE

BACKGROUND OF THE INVENTION

The present invention relates in general to electroacoustical transducing and more particularly concerns a novel loudspeaker driver and methods by which it is made characterized by superior acoustical performance while reducing manufacturing and materials costs. The invention may be relatively easily produced on a mass production basis with a high degree of automation while keeping the performance characteristics of each driver within relatively tight tolerances.

It is an important object of the invention to provide an improved loudspeaker driver.

It is another object of the invention to provide improved methods for making an improved loudspeaker driver.

It is a further object of the invention to achieve one or more of the preceding objects while reducing material and manufacturing costs.

It is still a further object of the invention to achieve one or more of the preceding objects with a loudspeaker driver that may be manufactured with a high degree of automation while maintaining relatively close tolerances.

It is a further object of the invention to achieve one or more of the preceding objects in a manner that facilitates economically securing a driver to a baffle in a loudspeaker system that maintains a high level of performance.

It is a further object of the invention to achieve one or more of the preceding objects while facilitating attachment of a voice-coil spider precisely, economically and reliably to the basket of the driver.

It is still a further object of the invention to achieve one or more of the preceding objects while eliminating buzzing of the driver basket relative to the front plate without resorting to external devices, such as buzz washers, adhesives, damping compounds or similar materials in the interface area between basket and front plate.

It is still another object of the invention to achieve one or more of the preceding objects while maintaining a high level of gap flux.

It is still a further object of the invention to achieve one or more of the preceding objects while providing essentially uniform air loading on the diaphragm.

It is still a further object of the invention to achieve one or more of the preceding objects with a structure that provides improved flange stiffness and allows for a flatter seal area between driver and baffle.

It is a further object of the invention to achieve one or more of the preceding objects while assuring that the flange area in contact with the baffle is essentially in a single plane to provide more uniform gasket compression where a gasket seal is used.

It is a further object of the invention to achieve one or more of the preceding objects with a loudspeaker driver arranged to assure centering of the driver in its mounting hole on the baffle while avoiding damaged flanges and poor sealing.

It is a further object of the invention to achieve one or more of the preceding objects while assuring that a mounting screw enters the baffle essentially normal to the flange surface, thereby minimizing unpredictable compression forces, the screw breaking through the side of the baffle mounting hole and stripping.

It is still another object of the invention to achieve one or more of the preceding objects with a loudspeaker driver characterized by predictable and accurate concentricity of the spider flange, the cone roll flange and any protrusions or indentations used in manufacture or assembly with the bore of the front pole plate.

It is still another object of the invention to achieve one or more of the preceding objects while maintaining the relative elevations of the flanges and front pole plate accurate and reproducible.

It is still another object of the invention to achieve one or more of the preceding objects while facilitating retention of the front pole plate during encapsulation.

It is still a further object of the invention to achieve one or more of the preceding objects while conveniently fastening the front pole plate with exceptionally high mechanical rigidity.

It is a further object of the invention to achieve one or more of the preceding objects with a front pole plate that may include a notch or keyway in its bore precisely and repeatedly oriented relative to the loudspeaker terminals.

It is another object of the invention to achieve one or more of the preceding objects with a loudspeaker driver that may use a non-inverted cone roll without a pad ring.

It is still another object of the invention to achieve one or more of the preceding objects with a loudspeaker driver whose span relative to the baffle is constant within relatively tight tolerances and that provides a flat surface for mating engagement with the baffle.

It is still a further object of the invention to achieve one or more of the preceding objects while providing a convenient means for mounting connection terminals in a manner that does not require a separate insulated strip and without supplementary fasteners.

It is still a further object of the invention to provide a loudspeaker driver capable of conveniently accommodating a flat spider of high dimensional stability.

It is still another object of the invention to achieve one or more of the preceding objects while conveniently providing both ventilation holes and terminal pad areas that may be established with a two-part mold to provide essentially uniform air loading on the diaphragm while minimizing stress concentrations from sharp corners and allowing the use of standard diameter rods as mold components to minimize mold costs.

SUMMARY OF THE INVENTION

A loudspeaker driver according to the invention comprises a plastic basket formed with an encapsulated front pole plate of low reluctance magnetic material. Preferably, the plate is formed by stamping to produce an exaggerated break edge in the stamped plate that may be used as an undercut for encapsulation. Preferably the front pole plate is octagonal and formed with a concentric opening having a notch extending radially outward therefrom for accommodating the voice coil, a return lead and a central round pole piece. Preferably, the round pole piece is force fit in a concentric opening of a back pole plate of low reluctance magnetic material, preferably also octagonal for coacting with the front pole plate to snugly sandwich an annular permanent magnet to establish a relatively high magnetic flux level in the airgap between the roumd pole piece and the concentric opening in the front pole plate.

Preferably the plastic basket is formed with an annular flat surface forward of the front pole plate to which a voice-coil spider, preferably flat, is fastened, preferably by applying heat through the periphery of the porous spider material to this flat surface to liquify the surface allowing the plastic material to flow into the porous spider material and firmly secure the spider to this surface after the heat is removed and the plastic material solidified upon cooling. Preferably, the plastic basket is formed with a pair of tabs extending radially outward from this surface formed with openings for accommodating insertable terminals to mechanically support them in insulatedly separated spaced relationship while being accessible through openings through which the voice coil leads may extend for connection to the terminals. Preferably, the plastic basket includes a surface extending forward and radially outward from the annular surface to which the spider is attached to another annular surface parallel to the pole plate for accommodating the edge of the diaphragm with the surface interconnecting the two parallel annular surfaces preferably being formed with a number of essentially uniformly distributed ventilating openings to permit uniform air loading of the diaphragm. Preferably these openings are elliptical and separated from an adjacent opening by a distance less than the minor diameter of an opening adjacent to the separating portion. The two openings adjacent to the tabs for accommodating the speaker terminal tabs are preferably larger than the others for accommodating a circular punch carrying a pin in the end for simultaneously defining this elliptical opening, the speaker terminal tabs and the opening in the tabs for accommodating the speaker terminal.

Preferably the plastic basket is formed with upstanding rim portions extending perpendicularly from the surface supporting the diaphragm edge which may function for protecting the diaphragm roll. These rim portions are preferably formed with a flat upper surface in a plane parallel to the pole plate for establishing a flat mounting surface from the diaphragm mounting annular surface. Preferably there are three of these mounting tabs equiangularly spaced for providing exceptionally stable mounting. These tabs may be formed with openings for accomodating screws and may function to guide the screws perpendicularly into a mounting baffle.

According to another feature of the invention, the upstanding rim portions may comprise a number of sections extending from one tab to an adjacent tab for making engagement in a twist-and-lock arrangement in the baffle.

Preferably the plastic basket is formed with radial ribs on the outside surface of the basket extending toward the mounting tabs to help assure centering in a baffle mounting hole. The plastic basket may also be formed with a number of studs having a flat upper surface in a common plane parallel to the front pole plate and between the planes of the annular surfaces to which the spider and diaphragm edges are secured to facilitate alignment in the course of assembling the drivers.

According to the method of the invention, the front pole plate is located in the rear of the mold for the basket and encapsulated by plastic material as the plastic material flows into the mold to form the basket. Preferably, the front plate is made by stamping to produce an undercut normally resulting from stamping a metal part with exaggerated punch-die clearance and oriented in the mold with the broken surface sloping rearwardly and radially inwardly so that plastic material flows in a region rearward of the front portion of the pole plate to firmly hold it in place upon cooling. According to another aspect of the invention a voice-coil spider, preferably flat, is positioned with its periphery seated on the first-mentioned annular surface and heat applied to this surface through the peripheral edge to cause the plastic material beneath to liquify and flow toward the heat source through the porous peripheral edge of the spider. The source of heat is then removed, allowing the plastic material to solidify and firmly secure the peripheral edge of the spider to the annular surface. Utilizing the accurate nature of the molded assembly, the precise location of the notch in the pole plate bore; preferably a single-layer helical voice coil assembly, preassembled to a mandrel may be inserted through the spider accurately locating the folded-over return wire within the notch. The notch enables a single-layer helical voice coil with a folded lead to be used without the attendant loss of flux that would result from a uniformly larger pole plate bore. After insertion of the coil on its attendant assembly mandrel, the adhesive for the neck joint is applied along with an alpha cyanoacrylate or similar adhesive on the flat surface for supporting the diaphragm edge. This adhesive is used for the bonding of a urethane or similar foam cone roll. The inherent flatness of the latter surface enables fixturing strength of the adhesive to be obtained uniformly in less than 2 seconds. After cure of the neck joint bond, the mandrel is removed and finishing of the device is accomplished by established techniques known to those skilled in the art. If a cloth roll cone is used, its periphery may be fastened using the techniques already described above for attachment of the spider.

Numerous other features, objects and advantages of the invention will become apparent from the following specification when read in connection with the accompanying drawing in which:

DETAILED DESCRIPTION OF PREFERRED EMBODIMENTS

Figure 1:
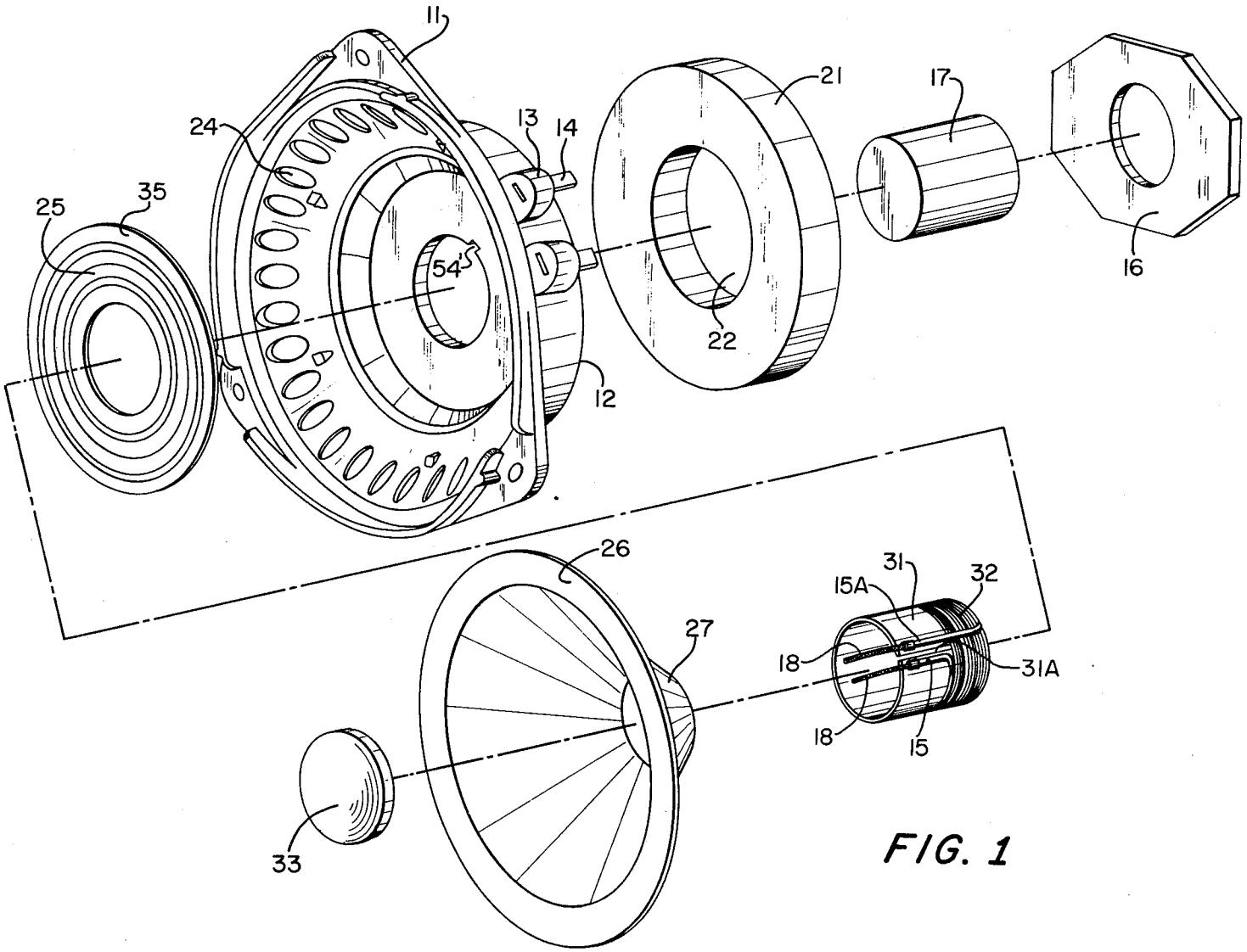
FIG. 1 is an exploded view of a loudspeaker driver according to the invention.
Figure 2:
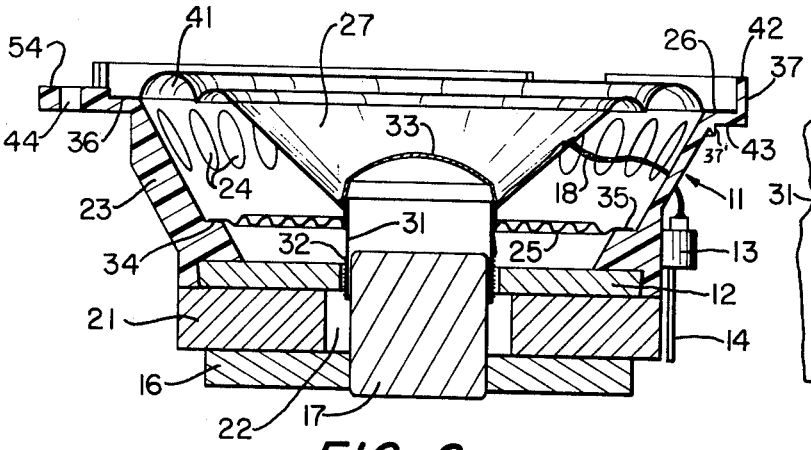
FIG. 2 is a diametrical sectional view through an embodiment of the invention.
Figure 3:
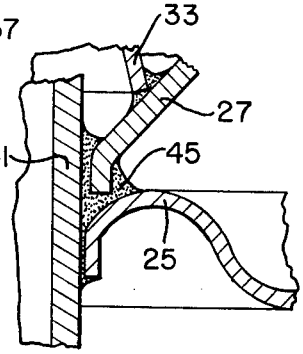
FIG. 3 is an enlarged view of a detail in FIG. 2 showing how the cone, spider and voice coil bobbin are secured together.

With reference now to the drawing and more particularly FIG. 1 thereof, there is shown an exploded view of a loudspeaker driver according to the invention having a plastic basket 11 with an embedded octagonal pole plate 12 of low reluctance magnetic material with plastic tabs such as 13 carrying speaker terminals such as 14 connected to the voice coil leads such as 18 in a manner best seen in FIG. 2. Rear octagonal pole plate 16 of low magnetic reluctance is formed with a central opening in which pole piece 17 is force fit and surrounded by high energy annular permanent magnet 21 formed with a central opening 22. Plastic basket 11 is formed with three ribs such as 23 (FIGS. 2, 5, 6) extending radially outward useful in centering the driver when inserted into a speaker mounting hole in the baffle and with an essentially continuous array of generally elliptical ventilating openings such as 24 around the intermediate portion of the basket between the spider 25 and the annular outside mounting lip 26 of cone 27. Voice coil bobbin 31 carries voice coil 32 and is secured to cone 27 and spider 25 as best seen in FIGS. 2 and 3. A dust cover 33 covers the top openings of bobbin 31 as best seen in FIG. 2. Flexible leads such as 18 interconnect the voice coil ends 15, 15A with driver terminals 14.

Voice coil 32 preferably comprises a single layer of anodized aluminum wire of rectangular cross section with bobbin 31 also of anodized aluminum having an axial slit 31A with end 15A from the rear end of the coil folded across the rest of the coil parallel to the coil axis aligned with keyway 54. One advantage of this arrangement is that the distance across the air gap is minimized while avoiding voice coil rubbing to maximize the magnetic flux in the gap and the efficiency of the driver. Another advantage is the high efficiency achieved by having so much conducting material in the air gap with the thin oxide layer providing adequate insulation for a moving assembly having relatively low inertia. Still another advantage resides in the low impedance of the single layer winding, typically 0.9 ohm so that nine may be connected in series in a BOSE 901 loudspeaker of the type described in U.S. Pat. No. 3,582,553 to present a nominal impedance of substantially 8 ohms. A further advantage is that bobbin 31 may be formed from sheet aluminum rolled around a mandrel.

Referring to FIG. 2, there is shown a diametrical section view of an assembled loudspeaker according to the invention along a section that bisects the terminals such as 14. The same reference symbols identify corresponding elements throughout the drawing. FIG. 2 shows voice coil 32 in the air gap between pole piece 17 and front pole plate 12 arranged so that the inside of bobbin 31 is just clear of pole piece 17 and voice coil 32 is just clear of the radially inside surface of front pole plate 12.

Plastic basket 11 is formed with a flat annular surface 34 above and parallel to front pole plate 12 to which the peripheral edge 35 of spider 25 is fastened, preferably by applying heat through peripheral edge 35 to flat annular surface 34 that causes the plastic material immediately below to liquify and flow through the porous material of peripheral edge 35. The heat is then removed, allowing the plastic to solidify and securely fasten peripheral edge 35 to surface 34 with spider 35 exactly parallel to front pole plate 12 and exactly perpendicular to the axis of the driver.

Plastic basket 11 is also formed with an annular surface 36 that is parallel to annular surface 34 and front pole plate 12 to which the peripheral edge 26 of cone 27 may be attached by adhesive or by the process described above of applying heat through the edge to melt the plastic below and then remove the heat or other suitable means. Plastic basket 11 is also formed with lips such as 37 extending perpendicularly upward from annular surface 36 high enough to protect the roll 41 of cone 27 and formed with a flat top surface 42 that is parallel to surfaces 36, 34 and front pole plate 12 to provide a flat annular surface for engagement with the baffle plate. As explained below in connection with FIG. 9 lips 37 also perform a sealing function. Plastic basket 11 is also formed with an annular surface 43 beneath annular surface 36 that is parallel to annular surface 36, annular surface 34, top surface 42 and front plate 12 for engagement with the baffle. Surface 43 may be used to insure precise positioning of the driver in good sealing relationship with conventional gasket construction. FIG. 2 shows one opening 44 for accommodating a fastening screw, there preferably being three equiangularly spaced openings 44. A feature of the invention is that openings 44 are precisely positioned to have their axes perpendicular to the baffle surface and have a close clearance for the fastening screw to insure that the fastening screws may be driven essentially exactly perpendicularly into the baffle to avoid stripping and the possibility of a fastening screw entering slantwise and projecting into the baffle driver opening.

Plastic basket 11 is also formed with three ribs such as 23 extending radially outward in the radial plane including the mounting holes 44 that help insure centering of the driver when mounting in the baffle.

Referring to FIG. 3, there is shown an enlarged view of the junction between bobbin 31, cone 27 and spider 25 of FIG. 2 showing how they are held together by fastening cement 45, such as epoxy resin, or other thermosetting adhesives.

Figure 4:
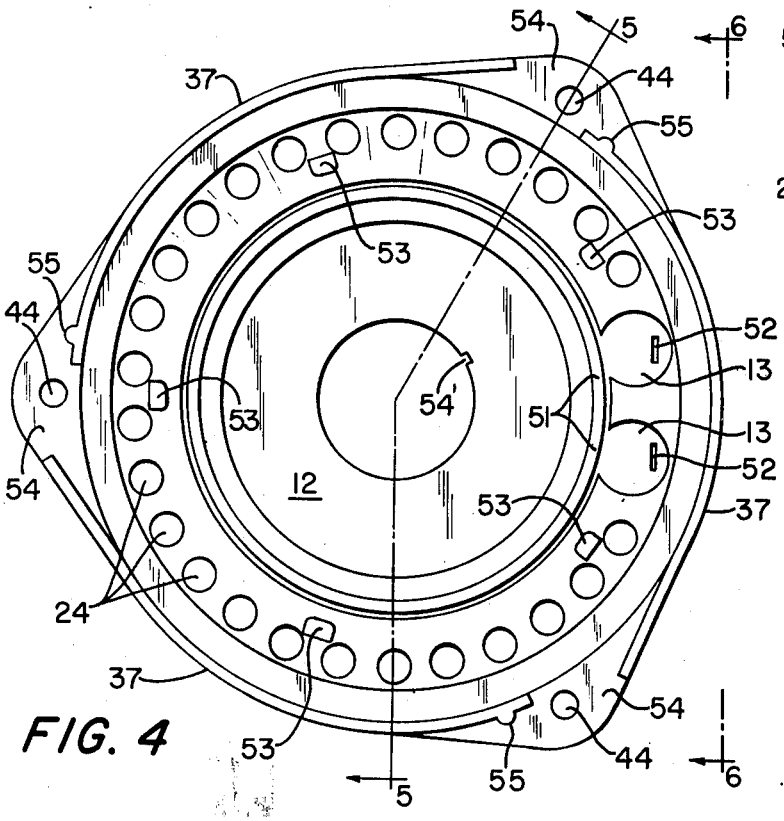
FIG. 4 is a top view of the plastic basket with embedded front pole plate according to the invention.

Referring to FIG. 4, there is shown a top view of plastic basket 11. There are 26 elliptical openings 24 of circular projection in the plan view of FIG. 4 and two larger generally elliptical openings 51 exposing tabs 13 that carry the speaker terminals in the slots 52. The minor diameter of each elliptical opening corresponds to the diameter of the circular projections in plan view. The angle subtended by radii of basket 11 passing through the centers of opening 51 is typically 25° so that the angular spacing between those centers is typically 12 ½° while the angular spacing between centers of the openings 24 is typically 12° and the minor diameter of each is typically ¼inch with the separation between adjacent openings being preferably less than the minor diameter of an adjacent opening and preferably the order of the minor diameter of an opening or less to provide good and uniform ventilation. The only departure in the specific example from uniform and symmetrical distribution of the openings is the inclusion of the larger openings 52 for access to the speaker terminal tabs 13 and for enabling these tabs to be conveniently formed during molding.

The number of openings and their spacing is such that unrestricted radial material flow is allowed during molding. The narrowness and the number of ribs thus developed gives a part with the best combination of uniform ventilation, uniform material flow, and uniform strength regardless of its rotational location after mounting. This substantially radial symmetry yields consistent, concentric radial post-mold shrinkage, radial shrinkage having no effect on speaker function.

Plastic basket 11 is formed with five equiangularly displaced steps 53 having a flat top surface in the same plane that is parallel to front polar plate 16 and flat annular surfaces 34 and 36 and between surfaces 34 and 36. Steps 53 allow stacking of the basket assemblies for shipping or storage purposes prior to speaker manufacture. Basket 11 is formed so that front pole plate 16 has a reference notch 54' along a radius that makes an angle with the radius bisecting tabs 13 of substantially 30° and is useful as a precise reference guide during assembly.

Plastic basket 11 is formed with three equiangularly spaced mounting tabs 54 carrying mounting openings 44 with three upstanding rim portions 37 extending between adjacent tabs 54 and each having a ridge 55 for making engagement with a recess in a mating rim portion in a baffle arranged to accommodate the drivers for snap-in insertion in a manner described in greater detail below. Openings 44 may or may not then be used. An assembled driver may also readily be secured to a conventional baffle by screws or other suitable fasteners inserted through openings 44 to secure the driver with three-point stability precisely located while the flat surfaces 43 of rim portions 37 define a common plane for engagement with a baffle board.

Figure 5:
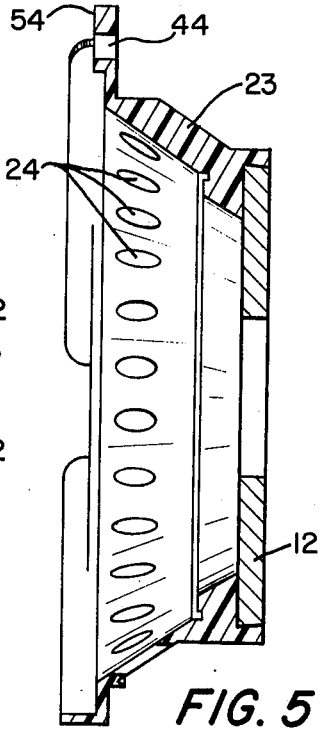
FIG. 5 is a two-radial sectional view through section 5—5 of FIG. 4.

Referring to FIG. 5, there is shown a sectional view along noncolinear radii along section 5—5 of FIG. 4 helpful in understanding the relationship in elevation of the different components of the basket.

Figure 6:
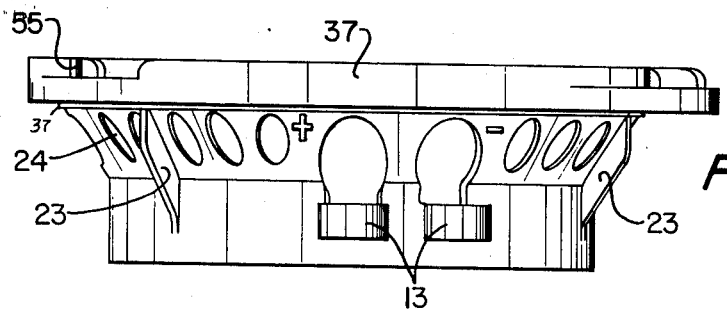
FIG. 6 is a view of the plastic basket according to the invention from plane 6—6 along the direction indicated in FIG. 4.

Referring to FIG. 6 there is shown a view from plane 6—6 of FIG. 4 in the direction indicated looking toward the speaker terminal mounting tabs 13.

Figure 7:
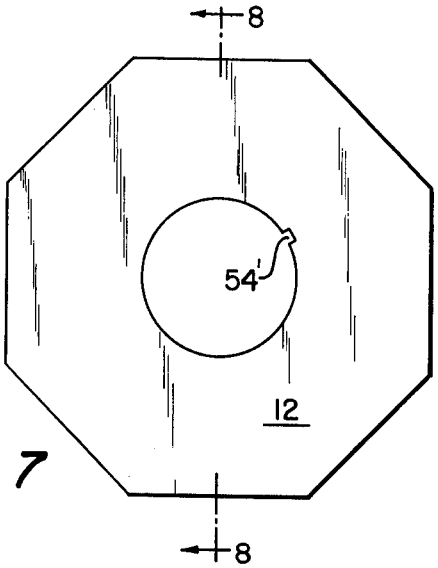
FIG. 7 is a plan view of the front pole plate.

Referring to FIG. 7, there is shown a plan view of front pole plate 12 that is a regular octagon and made of low reluctance magnetic material such as C-1010 to C-1018 hot rolled picked and oiled magnetic steel and formed with notch 54'.

Figure 8:
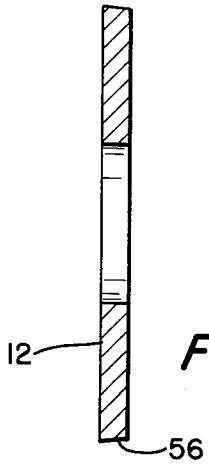
FIG. 8 is a view through section 8—8 of FIG. 7.

Referring to FIG. 8, there is shown a sectional view of front pole plate 12 through section 8—8 of FIG. 7 made by punching showing the central opening and how the break surface 56 tapers radially inward in progressing rearward to form an undercut where plastic may flow during molding to keep the octagonal front pole plate firmly embedded in plastic basket 11. Back plate 16 is substantially the same except that its central opening is of smaller diameter for force fitting central pole piece 17 and does not have the keyway. An important advantage of having these pole plates octagonal is that there is less waster material during manufacture as compared with a conventional round plate of area inscribed inside the octagonal outline of plates 12 and 16. Stated in terms of pole plates of equal area, the octagonal pole plates according to the invention have a span across opposed faces that is less than the diameter of a circular pole plate of the same effective area. Yet is has been discovered that from magnetic circuit considerations the octagonal plate performs satisfactorily.

Figure 9:
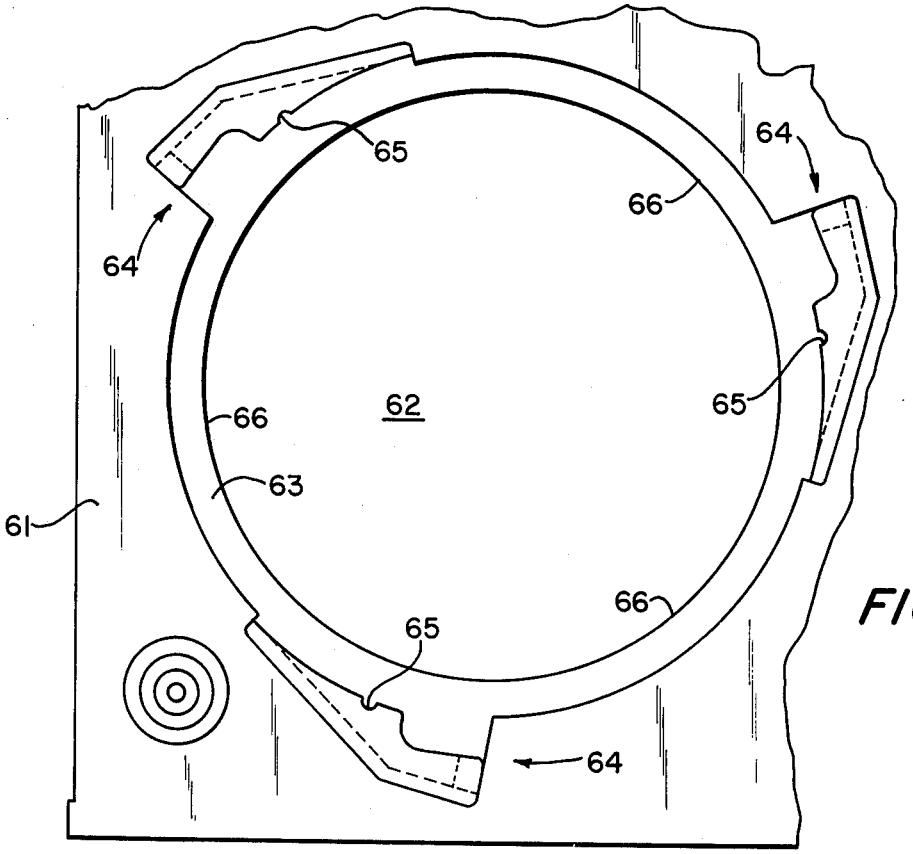
FIG. 9 is a fragmentary plan view of a baffle portion for mating engagement with a loudspeaker according to the invention.

Referring to FIG. 9, there is shown a portion of a baffle that may also be molded of plastic for accommodating the preferred form of drivers according to the invention. Baffle plate 61 is formed with an opening 62 inside a depressed annular surface 63 which surface 43 (FIG. 2) firmly engages when driver 11 is mounted in opening 62. The diameter of opening 62 is thus preferably just large enough to accommodate the portion of basket 11 below surface 43. Three equiangularly spaced recesses for accommodating tabs 54 are defined by the structures 64 open at the counterclockwise edge for receiving tabs 54 and formed with notches 65 for mating engagement with corresponding protrusions 55 of plastic basket 11. The height of the slit defined by the structure 64 is preferably slightly less than the thickness of tab 54 so that rotating a loudspeaker driver clockwise until a protrusion 55 mates with a notch 65 results in each tab 55 being firmly engaged while the ourside surface of rim portions 37 snugly engage the wall portions 66 extending perpendicularly from the plane of baffle 61 to establish a substantially fluid-tight seal with a driver without gaskets, other soft material such as Mortite or screws to significantly reduce assembly costs while improving reliability. If desired, screws or other fasteners may be installed in openings 44.

A specific embodiment of the invention comprises a 4½inch driver of the type used in the BOSE 901 loudspeaker system. Typical dimensions and materials not previously described above are as follows:

Plastic basket material thermoplastic PVE polyester, such as GE Valox with 20–30% glass fill.

Outside diameter of annular surface 36—4.4 inches.
Inside diameter of annular surface 36—3.96 inches.
Height of rim 37 above surface 46—0.25 inch.
Thickness of annular surface 46—0.075 inch.
Separation between surfaces 36 and 34—0.712 inch.
Outside diameter of annular surface 34—3.07 inches.
Inside diameter of annular surface 34—2.76 inches.
Separation between annular surface 36 and pole plate 12—0.27 inch.
Outside diameter just below annular surface 36—4.05 inches.
Outside diameter in the plane including front pole plate 12—3.39 inches.
Pole plate thicknesses—0.18 inch.
Pole plate span—3 inches.
Bore diameter in front plate 12—1.088 inches.

The preferred method of making drivers according to the invention is as follows:

1. Assemble back plate 16 with pole piece 17, magnet 21, and the basket assembly using an anaerobic adhesive.
2. Insert terminals 14 in the molded terminal cavities of tabs 13.
3. Center and bond spider 35.
4. Insert the mandrel coil assembly with voice coil 32.
5. Apply neck joint and cone roll adhesives.
6. Bond the cone roll 26 to surface 36.
7. Cure and proceed with lead dressing, dust cap bonding, tinsel soldering, and magnetizing.

There has been described a novel loudspeaker driver, components thereof and methods of manufacture characterized by numerous advantages many of which were enumerated above. It is evident that those skilled in the art may now make numerous other uses of and departures from the specific apparatus and techniques described herein without departing from the inventive concepts. Consequently, the invention is to be construed as embracing each and every novel feature and novel combination of features present in or possessed by the apparatus and techniques herein disclosed and limited solely by the spirit and scope of the appended claims.

What is claimed is:

1. In a loudspeaker assembly including a basket, diaphragm and means defining an air gap having a magnetic field therein, the improvement comprising, a single-layer voice coil formed by conducting wire of rectangular cross section wound upon a sheet metal bobbin having a longitudinal slit and an end portion of the conductor comprising the coil folded over from one end of the single layer to the other end, the means defining an air gap including a front pole plate formed with a central opening that comprises means for defining the air gap and a notch extending radially outward from the central opening of area slightly greater than the cross sectional area of the folded-over end portion with the folded-over end portion passing through said notch in noncontacting relationship with said front pole plate, and means for supporting said voice coil and bobbin in said air gap to substantially fill said air gap while being in noncontacting relationship with said means defining an air gap.

2. The improvement in accordance with claim 1 wherein said bobbin in said air gap is formed of anodized sheet aluminum, said single layer being wound upon said bobbin and formed of anodized aluminum of rectangular cross section with each turn of the coil insulatedly separated from but in mechanical contact with adjacent turns and said bobbin with the annular cross sectional area of said layer and said bobbin being slightly less than that of said air gap.

3. The improvement in accordance with claim 1 wherein said single layer is formed of anodized aluminum of rectangular cross section with each turn of the coil insulatedly separated from but in mechanical contact with adjacent turns with the annular cross sectional area of said layer and said bobbin being slightly less than that of said air gap and the resistance of said voice coil being less than one ohm, whereby a plurality of said loudspeaker assemblies may be connected with voice coils in series to provide a loudspeaker system having an acceptable nominal impedance.

4. The improvement in accordance with claim 3 wherein there are 9 of said loudspeaker assemblies with voice coils connected in series presenting a nominal impedance of substantially 8 ohms.

* * * * *